US007597414B2

(12) United States Patent
Na

(10) Patent No.: US 7,597,414 B2
(45) Date of Patent: Oct. 6, 2009

(54) HYBRID INKJET IMAGE FORMING APPARATUS HAVING REPLACEABLE SCANNING UNIT

(75) Inventor: Gu-hwan Na, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 32 days.

(21) Appl. No.: 11/509,049

(22) Filed: Aug. 24, 2006

(65) Prior Publication Data

US 2007/0097157 A1 May 3, 2007

(30) Foreign Application Priority Data

Nov. 3, 2005 (KR) ..... 10-2005-0104933

(51) Int. Cl.
*B41J 3/00* (2006.01)

(52) U.S. Cl. ..... 347/2; 347/49; 347/37; 347/42

(58) Field of Classification Search ..... 347/2, 347/42, 37, 49
See application file for complete search history.

(56) References Cited

U.S. PATENT DOCUMENTS 5,710,582 A 1/1998 Hawkins et al.
6,325,476 B1 * 12/2001 Lee ..... 347/3

FOREIGN PATENT DOCUMENTS

| | | |
|---|---|---|
| CN | 1222448 | 7/1999 |
| JP | 06-303373 | 10/1994 |
| JP | 08-051521 | 2/1996 |
| JP | 10-126570 | 5/1998 |
| JP | 10-136161 | 5/1998 |
| KR | 10-2004-0045700 | 6/2004 |

OTHER PUBLICATIONS

Chinese Office Action dated Jul. 11, 2008 in CN2006101416109.

* cited by examiner

*Primary Examiner*—Thinh H Nguyen
(74) *Attorney, Agent, or Firm*—Stanzione & Kim LLP

(57) ABSTRACT

A hybrid inkjet image forming apparatus having a replaceable scanning unit includes an array type inkjet head unit and a shuttle type inkjet head unit. One of the array type inkjet head unit and the shuttle type inkjet head unit is fixed to a main body frame at a predetermined distance from an advancing path of the printing medium, and the other one of the array type inkjet head unit and the shuttle type inkjet head unit is detachably mounted to a unit mount provided on the main body frame and disposed along a side of the one of the array type inkjet head unit and the shuttle type inkjet head unit. The replaceable scanning unit is detachably mounted in the unit mount to scan image data from a medium.

12 Claims, 4 Drawing Sheets

HYBRID INKJET IMAGE FORMING APPARATUS HAVING REPLACEABLE SCANNING UNIT

CROSS-REFERENCE TO RELATED APPLICATIONS

This application claims priority of Korean Patent Application No. 10-2005-0104933, filed on Nov. 3, 2005, in the Korean Intellectual Property Office, the disclosure of which is incorporated herein in its entirety by reference.

BACKGROUND OF THE INVENTION

1. Field of the Invention

The present general inventive concept relates to a hybrid inkjet image forming apparatus having a replaceable scanning unit and a replaceable inkjet head, and more particularly, to a hybrid inkjet image forming apparatus that can replace one of different inkjet head units of different types with a scanning unit.

2. Description of the Related Art

Generally, image forming apparatuses, such as printers, photo printers, copiers, fax machines, and digital multi-function products, are used to print images or documents on printing media. Printers are the most representative devices of the image forming apparatuses.

Inkjet printers form an image having a predetermined color on a surface of a printing medium, such as a sheet of paper or a sheet of fabric, by firing ink droplets onto a desired region of the printing medium. The inkjet printer includes an inkjet head that fires ink generally using a heater, a piezoelectric unit, or the like.

A conventional inkjet printer usually includes an inkjet head that prints an image on a printing medium such as paper while the inkjet head reciprocates in a direction perpendicular to a feeding direction of the paper, that is, a width direction of the paper. This inkjet head is called a shuttle type inkjet head, and an inkjet printer with the shuttle type inkjet head is called a shuttle type inkjet printer. However, since the shuttle type inkjet head reciprocates for printing, the conventional shuttle type inkjet printer has a low printing speed although it has high resolution.

A recently developed inkjet printer employs an inkjet head array arranged across the entire width of a printing medium, and rapidly printing an image on a feeding printing medium without a reciprocating motion of the inkjet head. This inkjet printer is called an array type inkjet printer. However, the array type inkjet printer, although suitable for high-speed printing, is not suitable for high-quality printing.

To obviate such problems of the shuttle type inkjet printer and the array type inkjet printer, a hybrid inkjet printer has been disclosed in U.S. Pat. No. 5,710,582. This hybrid inkjet printer includes a shuttle type inkjet head and an array type inkjet head placed in parallel, and selectively uses the inkjet heads in accordance with a user's demand. For example, when it is necessary to print a document (mostly, a black and white document) with high speed, the array type inkjet head is used, and when it is necessary to print a document (mostly, a color document) with high resolution, the shuttle type inkjet head is used.

However, in a case where the hybrid inkjet printer is employed for constructing a digital multi-function product having a scanner or copier function, a size of the digital multi-function product is likely to become bigger by adding a scanning unit above a printing part in the same way as in the conventional digital multi-function product. Further, the scanning unit requires a paper feeding path separate from that of the printing part, thereby further increasing a size and a manufacturing cost of the digital multi-function product.

SUMMARY OF THE INVENTION

The present general inventive concept provides a hybrid inkjet image forming apparatus having a scanning unit that can replace one of different inkjet head units of different types mounted on a main body frame.

The present general inventive concept also provides a hybrid inkjet image forming apparatus in which a printing media path is commonly used when an inkjet head unit and a scanning unit are mounted together, thereby improving an efficiency of space utilization thereof.

Additional aspects and advantages of the present general inventive concept will be set forth in part in the description which follows and, in part, will be obvious from the description, or may be learned by practice of the general inventive concept.

The foregoing and/or other aspects of the present inventive concept may be achieved by providing a hybrid inkjet image forming apparatus having an array type inkjet head unit to print an image on a printing medium using a head having a width at least equal to or larger than a width of the printing medium, and a shuttle type inkjet head unit to print an image on a printing medium using a shuttle head reciprocating in a width direction of the printing medium, the inkjet image forming apparatus including a first inkjet head unit fixed to a main body frame at a predetermined distance from an advancing path of the printing medium, a unit mount provided on the main body frame and disposed along a side of the first inkjet head unit, a second inkjet head unit detachably mounted in the unit mount and having a different type of inkjet head from the first inkjet head unit, and a replaceable scanning unit detachably mounted in the unit mount when replacing the second inkjet head unit to scan image data from a printed medium.

The first inkjet head unit may be one of the array type inkjet head array and the shuttle type inkjet head unit, and the second inkjet head unit may be the other one of the array type inkjet head and the shuttle type inkjet head unit.

The foregoing and/or other aspects of the present inventive concept may also be achieved by providing a hybrid inkjet image forming apparatus including a shuttle type inkjet head unit fixed to a main body frame at a predetermined distance from an advancing path of a printing medium to print an image on the printing medium using a shuttle head reciprocating in a width direction of the printing medium, a unit mount provided on the main body frame and disposed along a side of the shuttle type inkjet head unit, an array type inkjet head unit detachably mounted in the unit mount to print a second image on the printing medium using a head having a width at least equal to or larger than a width of the printing medium, and a replaceable scanning unit detachably mounted in the unit mount when replacing the array type inkjet head unit to scan image data from a printed medium.

The foregoing and/or other aspects of the present inventive concept may also be achieved by providing image forming apparatus including a unit mount having a common connecting portion, an inkjet head unit to be detachably mounted on the unit mount and having a terminal to correspond to the common connecting portion, and a scanning unit to be detachably mounted on the unit mount and having a second terminal to correspond to the common connecting portion.

The foregoing and/or other aspects of the present inventive concept may also be achieved by providing image forming apparatus including a unit mount having a position regulating portion guide, an inkjet head unit to be detachably mounted on the unit mount, and having a position regulating portion to correspond to the position regulating portion guide, and a scanning unit to be detachably mounted on the unit mount, and having a second position regulating portion to correspond to the position regulating portion guide.

The foregoing and/or other aspects of the present inventive concept may also be achieved by providing image forming apparatus including a unit mount having a position regulating portion guide and a common connecting portion, and an inkjet head to be mounted on the unit mount, having a first position regulating portion to correspond to the position regulating portion guide, and having a first terminal to correspond to the common connecting portion, and a scanning unit to be mounted on the unit mount, having a second position regulating portion to correspond to the position regulating portion guide, and having a second terminal to correspond to the common connecting portion.

The foregoing and/or other aspects of the present inventive concept may also be achieved by providing image forming apparatus including a main body frame, a unit mount fixed to the main body frame, and having a position regulating portion guide and a common connecting portion, and an array type inkjet head to be detachably mounted to the unit mount, having a position regulating portion to correspond to the position regulating portion guide, and having a terminal to correspond to the common connecting portion.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
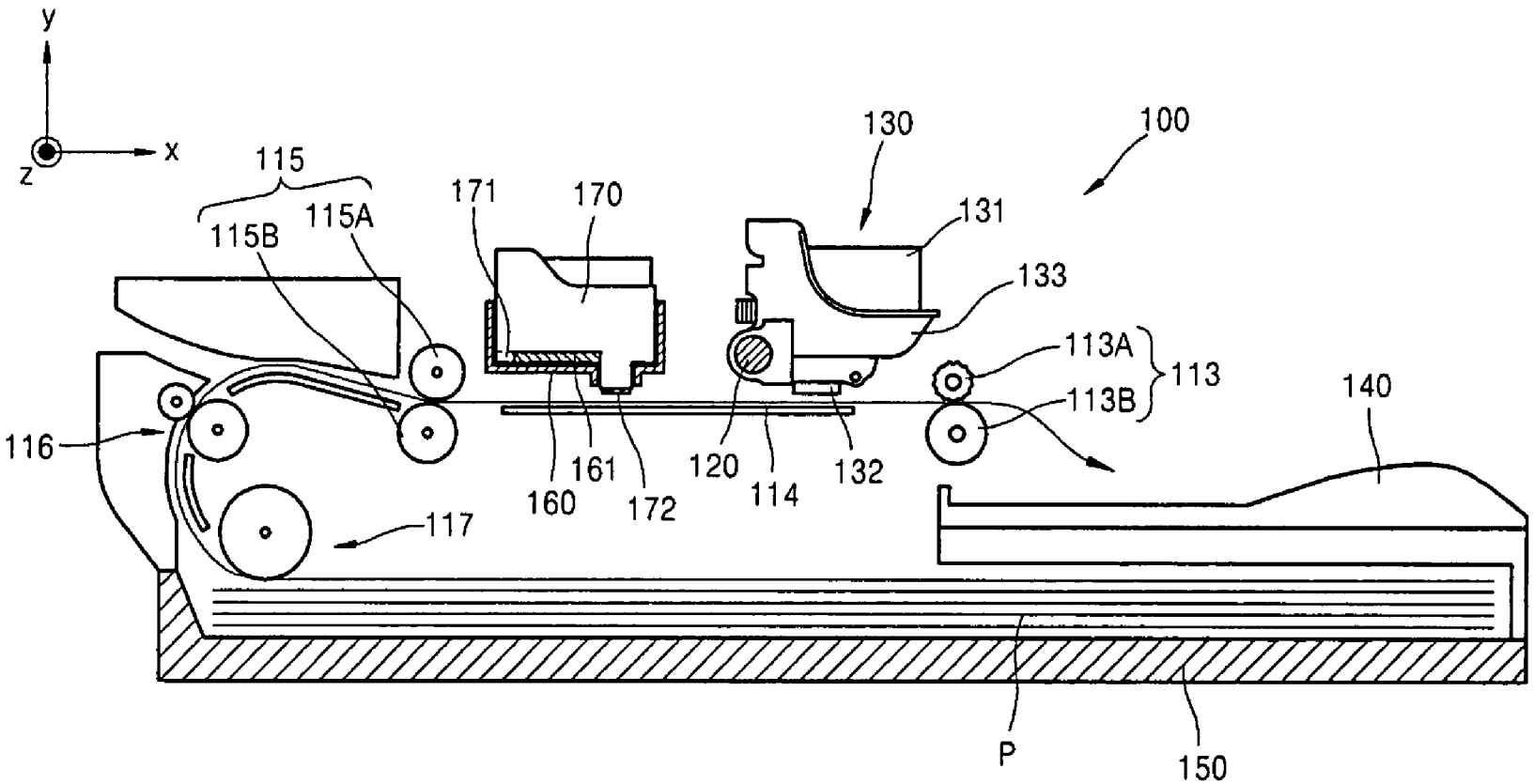
FIG. 1 schematically illustrates a hybrid inkjet image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 schematically illustrates a hybrid inkjet image forming apparatus 100 according to an embodiment of the present general inventive concept. The image forming apparatus 100 includes an array type inkjet head unit 170, a shuttle type inkjet head unit 130, a paper feeding cassette 150 to store printing media such as paper (P), a pick-up roller 117 to pick up the paper (P) one by one, feeding rollers 115 (115A and 115B) and 116 to feed the pick-up paper (P) to nozzle units 172 and 132 respectively disposed on the array type inkjet head unit 170 and the shuttle type inkjet head unit 130, an eject roller 113 (113A and 113B) to eject the paper (P) after printing, an output tray 140 to receive the ejected paper (P), and a controller (not shown) to control feeding operations of the rollers 113, 115, 116, and 117 and ink firing operations of the nozzle units 172 and 132.

That is, the controller controls the inkjet head units 170 and 130 and the paper feeding rollers 113, 115, 116, and 117, such that the ink is fired from the nozzle unit 172 of the array type inkjet head unit 170 or the nozzle unit 132 of the shuttle type inkjet head unit 130 to be scattered onto a proper position of the paper (P). In the present embodiment, the controller also controls a carrying operation of a carrier 133 (described later) on which a shuttle type inkjet head 131 is mounted.

According to the present embodiment, the array type inkjet head unit 170 is detachably mounted in a unit mount 160 adjacent to a paper advancing path along which the paper (P) advances during printing. The nozzle unit 172 of the array type inkjet head unit 170 is located close to the paper (P) at a predetermined distance when the array type inkjet head unit 170 is mounted in the unit mount 160. The unit mount 160 is fixed to a main body frame of the image forming apparatus 100. Further, a connecting circuit board 161 is placed in the unit mount 160 to electrically connect a replaceable unit to be mounted on the unit mount 160 to the controller of a main body of the image forming apparatus. A replaceable scanning unit 180 (FIG. 2) as well as the array type inkjet head unit 170 can be detachably mounted in the unit mount 160 as the replaceable unit.

The replaceable scanning unit 180 and the array type inkjet head unit 170 can scan a document and form an image on the paper (P), respectively, when the controller of the main body is electrically connected to a corresponding circuit of the replaceable scanning unit 180 and the array type inkjet head unit 170 through the connecting circuit board 161.

The array type inkjet head unit 170 includes at least one position regulating portion 171 at a side thereof contacting an inner side of the unit mount 160. The position regulating portion 171 is guided by a position regulating portion guide 162 (FIG. 2) placed in the unit mount 160 to correspond to the position regulating portion 171. The position regulating portion 171 and the position regulating portion guide 162 are precisely located at a predetermined position of the array type inkjet head unit 170 and the unit mount 160.

In the present embodiment, the shuttle type inkjet head unit 130 includes a shaft-shaped guide 120, the carrier 133, and the shuttle type inkjet head 131. The shaft-shaped guide 120 of the shuttle type inkjet head unit 130 is fixedly disposed at the main body frame of the image forming apparatus 100. The carrier 133 is mounted on the shaft-shaped guide 120 so that the carrier 133 and the shuttle type inkjet head 131 reciprocate along the shaft-shaped guide 120 to form an image on the paper (P).

The carrier 133 may have a second connecting circuit board formed thereon to electrically connect a corresponding circuit of the shuttle type inkjet head 131 to the control unit of the main body of the image forming apparatus. The shuttle type inkjet head 131 can form an image on the paper (P) when the controller of the main body is electrically connected to the shuttle type inkjet head 131 through the second connecting circuit when the shuttle type inkjet head 131 is detachably mounted to the carrier 133.

The shuttle type inkjet head unit 130 is disposed along a side of the array type inkjet head unit 170 along the paper advancing path. The shaft-shape guide 120 is disposed in a width direction of the paper (P) in parallel with the unit mount 160. The carrier 133 is coupled to the guide 120 to reciprocate thereon. The carrier 133 accommodates the shuttle type inkjet head 131 and reciprocates in the width direction of the paper (P) using a driving unit (not shown).

The shuttle type inkjet head 131 includes the nozzle unit 132 to fire ink on the paper (P) according to a control signal transmitted from the controller through the second connecting circuit board. The shuttle type inkjet head unit 130 is mainly used to print a high-resolution image, and may be used alternately with the array type inkjet head unit 170 rather than used with the array type inkjet head unit 170 at the same time.

Usually, the array type inkjet head unit 170 prints an image on the feeding paper (P) at a fixed position with respect to the main body frame. The array type inkjet head unit 170 is mainly used for high-speed printing, such as when printing a document with high resolution is not required. The array type inkjet head unit 170 includes the nozzle unit 172 having a length at least equal to or larger than the width of the paper (P).

The image forming apparatus 100 may be a hybrid inkjet image forming apparatus including both the array type inkjet head unit 170 and the shuttle type inkjet head unit 130 and may use the inkjet head units 170 and 130 alternately in accordance with a desired purpose, thereby performing both high-speed printing and high-resolution printing.

Figure 2:
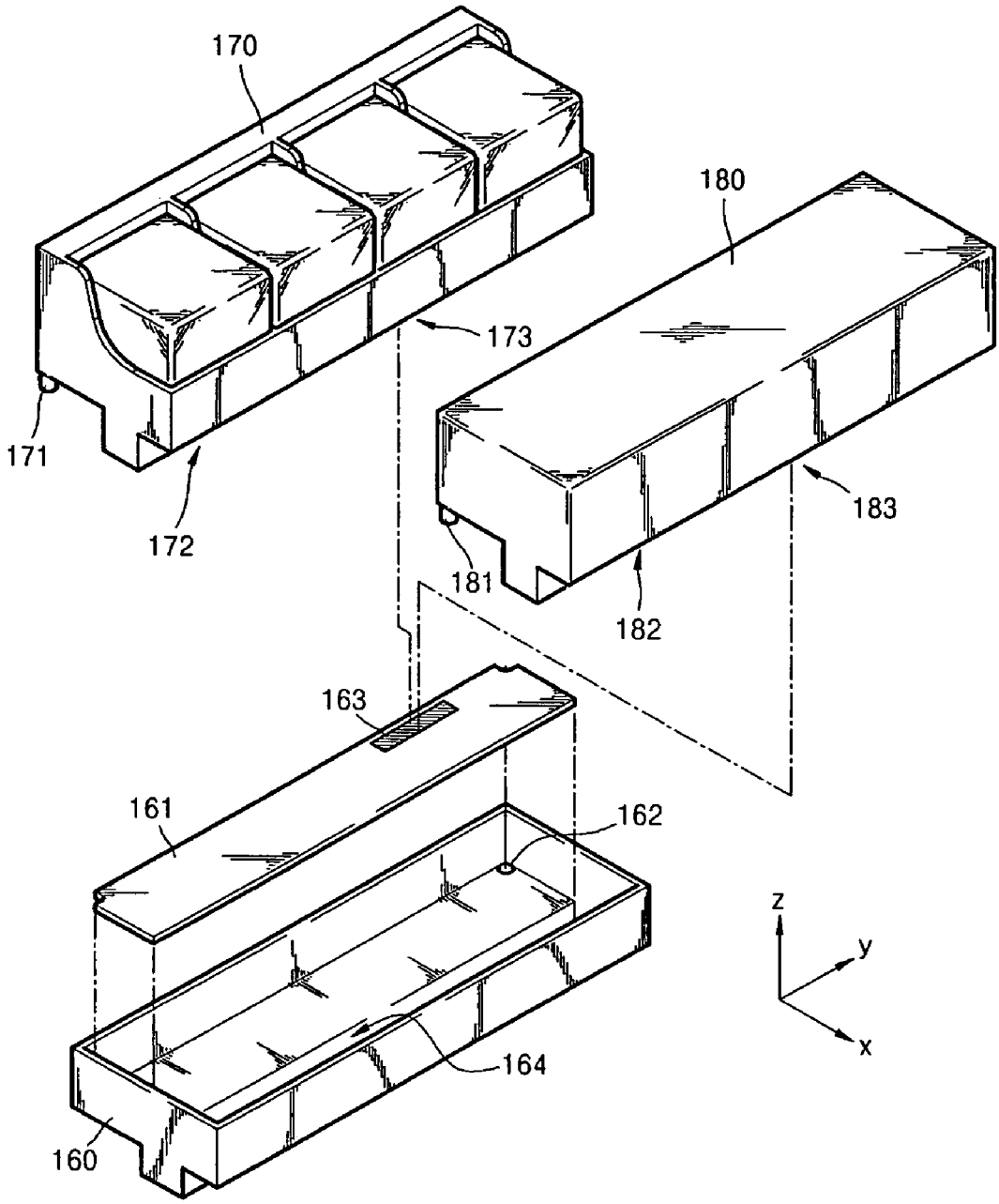
FIG. 2 illustrates a unit mount and different units to be alternately mounted on the unit mount in the image forming apparatus of FIG. 1.

The image forming apparatus 100 is configured such that the shuttle type inkjet head unit 130 is fixedly mounted to the carrier 133, and the array type inkjet head unit 170 is detachably mounted in the unit mount 160 to be replaced with the scanning unit 180 (FIG. 2). That is, the carrier 133 and the unit mount 160 are fixedly mounted to the main body frame, and the shuttle type inkjet head unit 130 and the array type inkjet head unit 170 is detachably mounted in the carrier 133 and the unit mount 160, respectively. Here, the array type inkjet head unit 170 is detached from the unit mount 160, and the scanning unit 180 can be mounted to the unit mount 160 whereas the shuttle type inkjet head unit 130 does not have to be detached to be replaced with the scanning unit. That is, since the shuttle type inkjet head 131 may be fixedly mounted on the carrier 131, and the carrier 131 is permanently mounted on the guide 120 to reciprocate to print with respect to the paper (P), the shuttle type inkjet head unit 130 is fixed on the main body frame compared to the array type inkjet head unit 170 which is detached from the unit mount 160 of the main body unit to be replaced by the scanning unit 180. However, the present general inventive concept is not limited thereto.

According to the present embodiment, a first inkjet head unit, that is, one of the array type inkjet head unit 170 and the shuttle type inkjet head unit 130, is fixedly installed on the main body frame of the image forming apparatus 100, and a second inkjet head unit, that is, the other one of the array type inkjet head unit 170 and the shuttle type inkjet head unit 130, is detachably mounted to the main body frame of the image forming apparatus 100, for example, in the unit mount 160. Therefore, a modulated shuttle type inkjet head unit can be detachably mounted in the unit mount 160 and an array type inkjet head unit can be fixedly installed to the main body frame.

In FIG. 1, an x-axis denotes the advancing direction of the paper (P), a y-axis denotes the width direction of the paper (P), and a z-axis denotes a perpendicular direction to a plane defined by the x-axis and y-axis.

The nozzle unit 172 of the array type inkjet head unit 170 and the nozzle unit 132 of the shuttle type inkjet head unit 130 are disposed at a predetermined distance from the paper (P). A paper guide 114 faces the two nozzle units 172 and 132 so that the paper passes through between the paper guide 114 and the two nozzle units 172 and 132.

The paper guide 114 supports a back side of the feeding paper (P) to keep constant the predetermined distance between the feeding paper (P) and the nozzle units 172 and 132. The predetermined distance between the paper (P) and the nozzle units 172 and 132 may range from about 0.5 to about 2.5 mm. Meanwhile, when the replaceable scanning unit 180 is mounted in the unit mount 160 instead of the array type inkjet head unit 170, the paper guide 114 supports a printed medium, such as a document, to be scanned by the replaceable scanning unit 180.

The eject roller 113 includes a star wheel 113A having an axis aligned in the width direction of the paper (P), and a supporting roller 113B facing the star wheel 113B to support the paper (P). The start wheel 113B makes point-contact with the paper (P) at a top surface of the paper (P), so that an incompletely-dried ink image formed by ink fired onto the paper (P) can be prevented from being contaminated. Further, if a next paper (P) is stack on the output tray 140 before ink on a previous paper (P) is not completely dried, the incompletely-dried ink image can be damaged or a bottom surface of the next paper (P) can be contaminated by the ink. To prevent this, an additional drying unit (not shown) may be added.

FIG. 2 shows the unit mount 160 and different units to be alternately mounted on the unit mount 160 in the image forming apparatus 100 of FIG. 1. The different units may be the array type inkjet head unit 170 and the scanning unit 180.

Referring to FIGS. 1 and 2, the unit mount 160 is fixedly installed to the main body frame of the image forming apparatus 100 as described above. The unit mount 160 has a bottom opening 164 in the width direction (X) of the paper (P), such that when one of the units 170 and 180 is selectively mounted in the unit mount 160, the unit 170 or 180 can be partially exposed toward the paper (P) passing under the unit mount 160 through the bottom opening 164. When the array type inkjet head unit 170 is mounted in the unit mount 160, the nozzle unit 172 provided at a lower portion of the array type inkjet head unit 170 is exposed through the opening 164. When the replaceable scanning unit 180 is mounted in the unit mount 160, a slit 182 made in a lower portion of the replaceable scanning unit 180 is exposed through the opening 164 to allow a light beam generated from an emitter to pass through the slit 182 and the opening 164 toward the document and to receive the light beam reflected from the document through the opening 164 and the slit 182. Though not shown, the replaceable scanning unit 180 includes a light-emitting unit and an image sensor, such that the replaceable scanning unit 180 can scan an image through the slit 182. A light beam is emitted from the light-emitting unit to pass through the slit 182 and the opening 164 toward the document, and the light beam reflected from the document is received from the document through the opening 164 and the slit 182. An image signal corresponding to the scanned document is transmitted to the controller through the connecting circuit board 161.

Further, the unit mount 160 includes the connecting circuit board 161. The connecting circuit board 161 is electrically connected to the controller (not shown) of the main body of the image forming apparatus 100, such that the unit 170 or 180 can be connected to the controller through the connecting circuit board 161 when the unit 170 or 180 is mounted in the unit mount 160. The connecting circuit board 161 includes a common connecting portion 163, and the array type inkjet head unit 170 and the replaceable scanning unit 180 include connecting terminals 173 and 183 corresponding to the common connecting portion 163, respectively.

Alternatively, the connecting circuit board 161 may include two connecting portions, and the units 170 and 180 may include connecting terminals at different positions thereof to be connected to corresponding ones of the two connecting portions, respectively.

When the array type inkjet head unit 170 or the replaceable scanning unit 180 is mounted in the unit mount 160, the controller may detect which unit is mounted, so as to perform a control operation accordingly.

Further, the array type inkjet head unit 170 and the replaceable scanning unit 180 may include at least one position regulating portion 171 and 181 at a same location with respect to the unit mount 160, respectively. The position regulating portions 171 and 181 are guided by the position regulating portion guide 162 to precisely mount the respective units 170 and 180 to the unit mount 160. As an example, the position regulating portions 171 and 181 may be shaped like a protrusion, and the position regulating portion guide 162 may be shaped like a hole corresponding the protrusion. Further, the protrusion shape and the hole shape can be interchangeable with each other.

Figure 3:
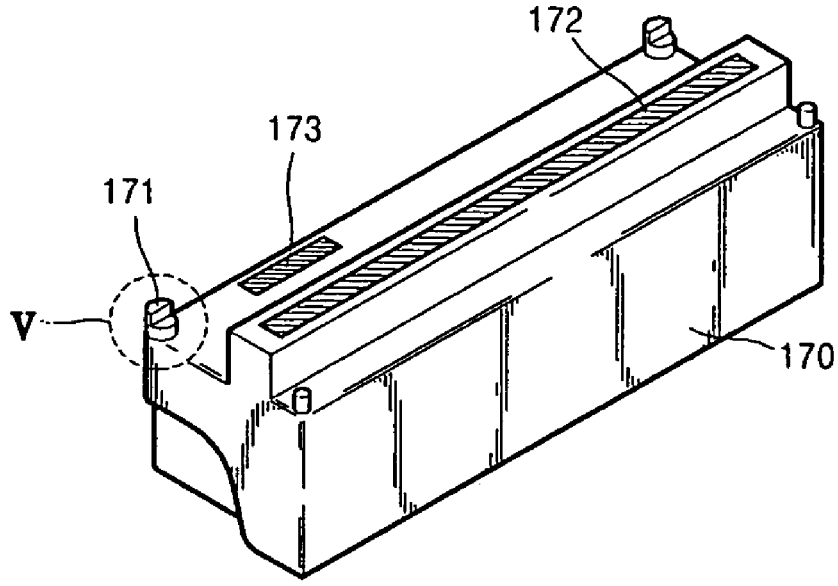
FIG. 3 illustrates a bottom of an array type inkjet head unit of FIG. 2.

FIG. 3 illustrates a bottom of the array type inkjet head unit 170 of FIG. 2. As described above, the array type inkjet head unit 170 of this embodiment includes the nozzle unit 172, the connecting terminal 173 at a position contacting the common connecting portion 163 of the connecting circuit board 161, and the at least one position regulating portion 171 at a position (e.g., a bottom corner) corresponding to the position regulating portion guide 162 of the unit mount 160

Figure 4:
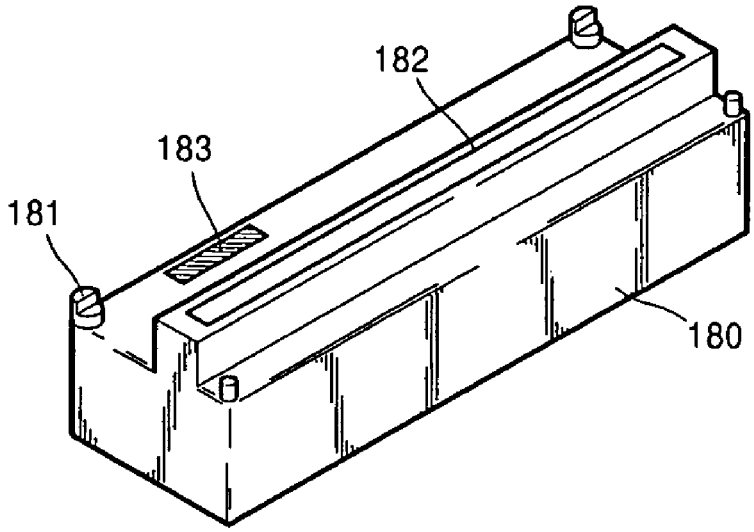
FIG. 4 illustrates a bottom part of a replaceable scanning unit of FIG. 2.

FIG. 4 illustrates a bottom portion of the replaceable scanning unit 180 of FIG. 2. The replaceable scanning unit 180 may have the same shape as the array type inkjet head unit 170 depicted in FIG. 3 at a portion contacting the inside of the unit mount 160, except for the slit 182 for scanning.

Figure 5:
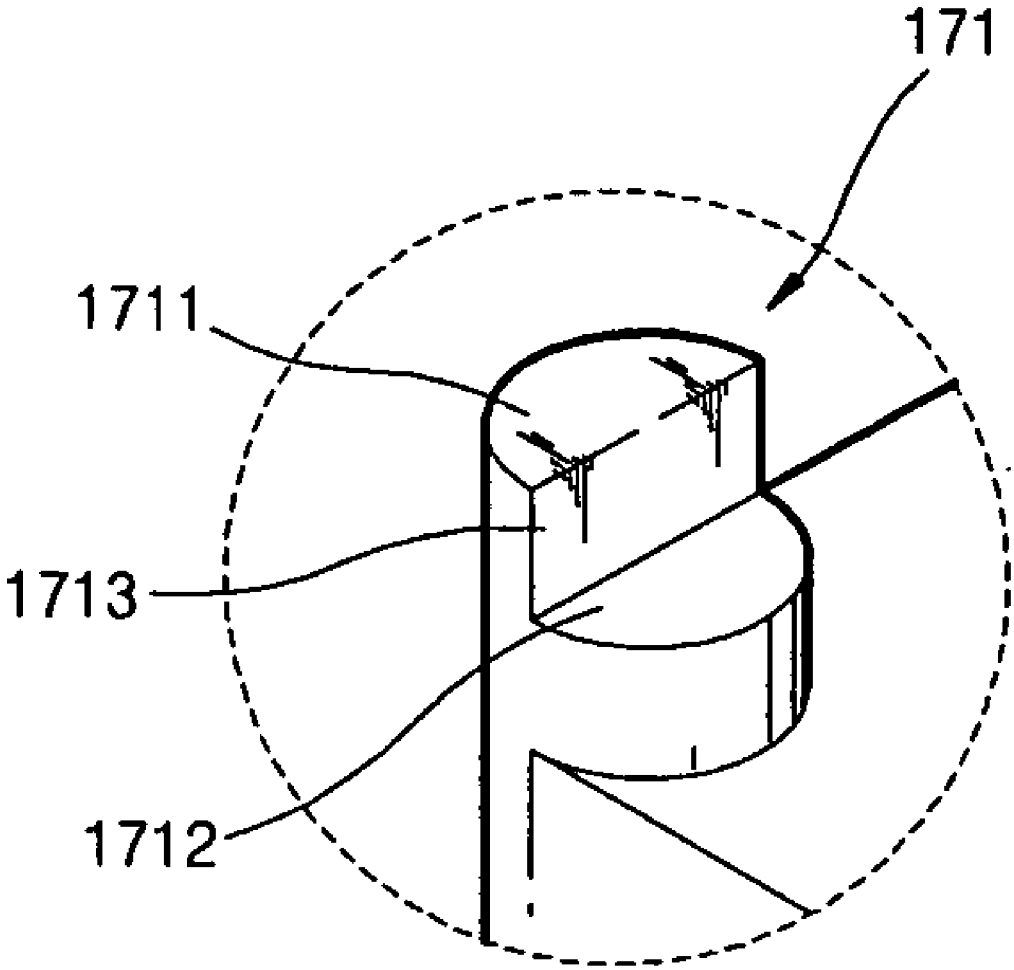
FIG. 5 illustrates an enlarged view of a portion V of the array type inkjet head unit of FIG. 3.

FIG. 5 is an enlarged perspective view illustrating a portion V of the array type inkjet head of FIG. 3. The position regulating portion 171 may have a circular protrusion shape with a step. The step can be formed in various shapes. For example, as illustrated in FIG. 5, the step includes a semi-circular top 1711, a semi-circular bottom 1712 forming a circle with the semicircular top 1711, and a vertical surface 1713 between the semi-circular top 1711 and the semi-circular bottom 1712. Though not shown, the position regulating portion guide 162 also has a circular stepped hole to correspond to the shape of the position regulating portion 171. The top 1711 and the bottom 1712 may restrict a vertical motion of the array type inkjet head unit 170 with respect to the unit mount 160, and the vertical surface 1713 may restrict a horizontal motion of the array type inkjet head unit 170 with respect to the unit mount 160. The position regulating portion 181 may have the same circular protrusion shape as the position regulating portion 171.

As described above, in the hybrid inkjet image forming apparatus with the replaceable scanning unit according to the present embodiment, at least one inkjet head unit and the replaceable scanning unit can be mounted at the same time, thereby maximizing efficiency in utilization of space and components.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A hybrid inkjet image forming apparatus comprising:

a shuttle type inkjet head unit fixed to a main body frame at a predetermined distance from an advancing path of a printing medium to print an image on the printing medium using a shuttle head reciprocating in a width direction of the printing medium;

a unit mount provided on the main body frame and disposed along a side of the shuttle type inkjet head unit;

an array type inkjet head unit detachably mounted in the unit mount to print a second image on a second printing medium using a head having a width at least equal to or larger than a width of the printing medium; and a replaceable scanning unit detachably mounted in the unit mount when the array type inkjet head unit is detached from the unit mount to scan image data from a printed medium.

2. The hybrid inkjet image forming apparatus of claim 1, wherein the unit mount comprises a connecting circuit board therein to connect one of the array type inkjet head unit and the replaceable scanning unit mounted on the unit mount to a main body thereof.

3. The hybrid inkjet image forming apparatus of claim 2, wherein each of the array type inkjet head unit and the replaceable scanning unit comprises a connecting terminal at a same position of a contact region to correspond to the connecting circuit board.

4. The hybrid inkjet image forming apparatus of claim 1, wherein:

each of the array type inkjet head unit and the replaceable scanning unit comprises at least one position regulating portion disposed at a corresponding position thereof; and the unit mount comprises a position regulating portion guide to receive the at least one position regulating portion to precisely mount the array inkjet head unit or the replaceable scanning unit to the unit mount.

5. The hybrid inkjet image forming apparatus of claim 4, wherein the position regulating portion has a protrusion shape, and the position regulating portion guide has a hole shape corresponding to the protrusion shape.

6. The hybrid inkjet image forming apparatus of claim 5, wherein the position regulating portion has a shape of a step.

7. A hybrid inkjet image forming apparatus comprising:

a unit mount having a common connecting portion;

an array inkjet head unit to be detachable mounted on the unit mount and having a terminal to correspond to the common connecting portion;

a scanning unit to be detachably mounted on the unit mount when the array type inkjet head unit is detached from the unit mount and having a second terminal to correspond to the common connecting portion; and an opening formed on the unit mount, wherein the inkjet head unit comprises a nozzle to correspond to the opening of the unit mount, and the scanning unit comprises a slit to correspond to the opening of the unit mount.

8. A hybrid inkjet image forming apparatus comprising:

a unit mount having a common connecting portion;

an array inkjet head unit to be detachably mounted on the unit mount and having a terminal to correspond to the common connecting portion;

a scanning unit to be detachably mounted on the unit mount when the array type inkjet head unit is detached from the unit mount and having a second terminal to correspond to the common connecting portion; and a main body frame having a paper guide to form a paper advancing path of a printing medium with the unit mount, wherein the unit mount is fixedly mounted on the main body frame, and the inkjet head unit is detached from the unit mount when the scanning unit is mounted on the unit mount.

9. A hybrid inkjet image forming apparatus comprising:

a unit mount having a common connection portion;

an array inkjet head unit to be detachably mounted on the unit mount and having a first terminal to correspond to the common connecting portion;

a scanning unit to be detachably mounted on the unit mount when the array type inkjet head unit is detached from the unit mount and having a second terminal to correspond to the common connection portion;

one or more position regulating portion guides formed on the unit mount;

one or more first position regulating portions formed on the inkjet head to be guided by corresponding ones of the one or more position regulating portion guides; and one or more second position regulating portions formed on the scanning unit to be guided by corresponding ones of the one or more position regulating portion guides.

10. The hybrid inkjet image forming apparatus of claim 9, wherein the one or more position regulating portion guides are disposed in at least one of widthwise and lengthwise directions of the unit mount.

11. The hybrid inkjet image forming apparatus of claim 9, wherein the common connecting portion is disposed between the one or more position regulating portion guides.

12. The hybrid inkjet image forming apparatus of claim 9, wherein the first terminal is disposed between the one or more first position regulating portions, and the second terminal is disposed between the one or more second position regulating portions.

* * * * *

UNITED STATES PATENT AND TRADEMARK OFFICE

CERTIFICATE OF CORRECTION

PATENT NO. : 7,597,414 B2
APPLICATION NO. : 11/509049
DATED : October 6, 2009
INVENTOR(S) : Gu-hwan Na It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 75 days.

Signed and Sealed this

Twenty-eighth Day of September, 2010

David J. Kappos

David J. Kappos
*Director of the United States Patent and Trademark Office*